US005111616A

United States Patent [19]

Calabrese

[11] Patent Number: 5,111,616

[45] Date of Patent: May 12, 1992

[54] WEATHERSEAL APPARATUS FOR DOUBLE HUNG WINDOWS

[76] Inventor: Anthony R. Calabrese, 95 Arlmont St., Arlington, Mass. 02174

[21] Appl. No.: 727,775

[22] Filed: Jul. 10, 1991

[51] Int. Cl.[5] ..... B65B 31/00

[52] U.S. Cl. ..... 49/406; 49/493

[58] Field of Search ..... 49/406, 458, 432, 493, 49/485

[56] References Cited

U.S. PATENT DOCUMENTS

| | | | |
|---|---|---|---|
| 979,631 | 12/1910 | Yeager | 49/493 |
| 1,669,599 | 5/1928 | Champion | 49/406 |
| 1,885,922 | 11/1932 | Kunz et al. | 49/493 X |
| 1,946,728 | 2/1934 | Bell | 49/458 X |
| 2,134,477 | 10/1938 | Hendriksen | 49/406 |
| 2,521,617 | 9/1950 | Webster | 49/406 X |
| 3,124,850 | 3/1964 | Johnson | 49/458 X |
| 3,383,801 | 3/1968 | Dallaire | 49/458 |
| 4,437,266 | 3/1984 | Keller | 49/406 X |

*Primary Examiner*—Philip C. Kannan
*Attorney, Agent, or Firm*—Henderson & Sturm

[57] ABSTRACT

A weatherproof sealing apparatus (10) to seal the opening between upper (200) and lower (100) window sashes in the open position; wherein, the sealing apparatus (10) includes a support member (13) having a generally cruciform cross-section and a resilient sealing block (20) attached to, and projecting outwardly from, the support member (13) to compressively engage the space between the upper (200) and lower (100) window sashes.

6 Claims, 3 Drawing Sheets

WEATHERSEAL APPARATUS FOR DOUBLE HUNG WINDOWS

BACKGROUND ART

This invention was the subject matter of Document Disclosure Program Registration No. 254669 which was filed in the United States Patent and Trademark Office on Jun. 4, 1990.

TECHNICAL FIELD

The present invention relates to sealing arrangements for weatherproofing windows, and in particular to a customizable apparatus that will conform to virtually all window configurations to provide a weatherproofing barrier between the window sashes.

As can be seen by reference to the following U.S. Pat. Nos. 1,946,728; 3,124,850; 3,383,801; and 3,432,966; the prior art is replete with myriad and diverse window sash sealing arrangements for weatherproofing window assembles.

While all of the aforementioned prior art constructions are more than adequate for the basic purpose and function for which they have been specifically designed, these patented arrangements are generally inherently deficient in that they uniformly only apply to a specific style of window; wherein most instances permanent hardware must be permanently attached to the relatively moveable window sashes.

In addition in most of the prior art arrangements an ineffective air barrier is created as opposed to a true weather tight seal between the sashes particularly when the sashes are disposed in a partially open disposition relative to one another.

As a consequence of the foregoing situation, there has existed a longstanding need for a low cost weatherseal apparatus which effectively and efficiently seals the open space between the sashes in a complete manner; and, which is easy to install and remove; as well as providing an aesthetic appearance; and, the provision of such a construction is a stated objective of the present invention.

DISCLOSURE OF THE INVENTION

Briefly stated, the weatherseal apparatus that forms the basis of the present invention comprises a resilient sealing unit and a support unit; wherein the resilient sealing unit closely conforms to the contours of the particular window configuration; and, wherein the support unit maintains the integrity of the resilient sealing unit while allowing easy installation and removal of the apparatus, as well as providing an overall generally pleasing aesthetic appearance.

As will be explained in greater detail further on in the specification, the support unit is further provided with a generally cruciform configuration; wherein, the lower panel of the cruciform stem provides a lateral securing surface for the resilient sealing unit; the upper panel of the cruciform stem provides a means of engaging and disengaging the apparatus relative to the window sashes; and, wherein the cross-arm panels of the cruciform function as spacing and stiffening elements .

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
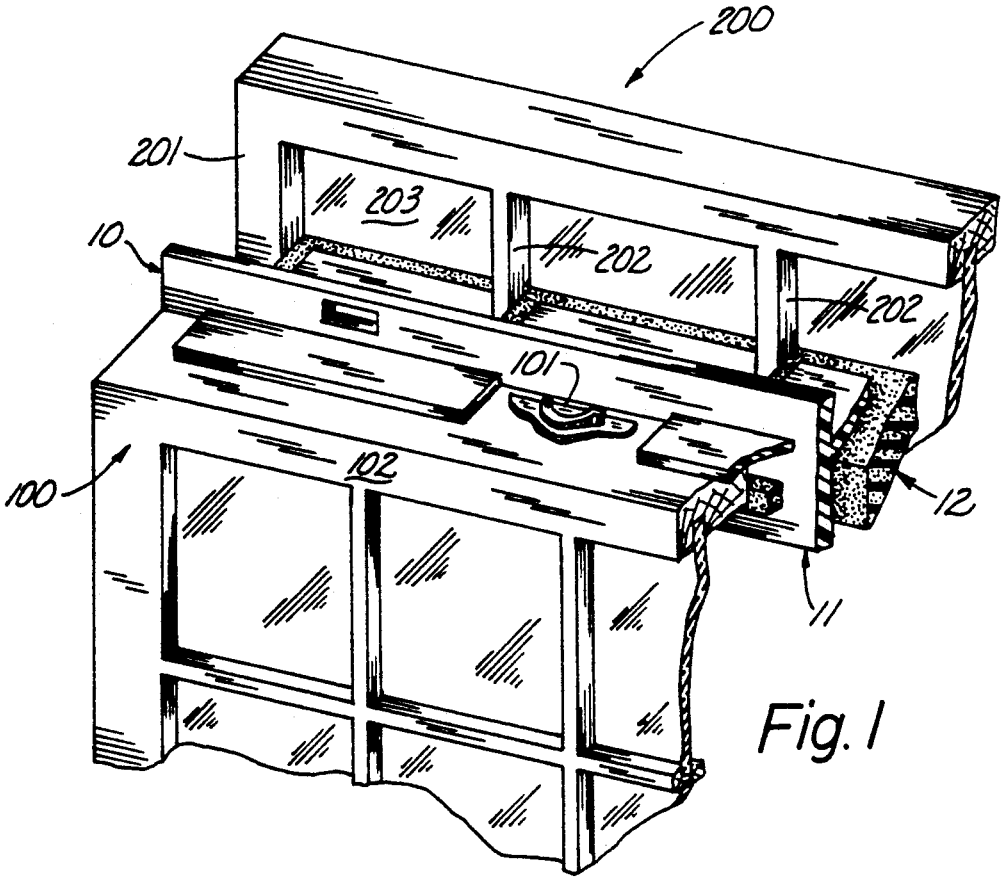
FIG. 1 is a perspective view of the apparatus installed between two window sashes.

As can be seen by reference to the drawings, and in particular to FIG. 1, the weatherproof sealing apparatus for windows that forms the basis of the present invention is designated generally by the reference numeral (10). The apparatus (10) comprises in general a support unit (11) and a resilient sealing unit (12). These units will now be described in seriatim fashion.

Figure 2:
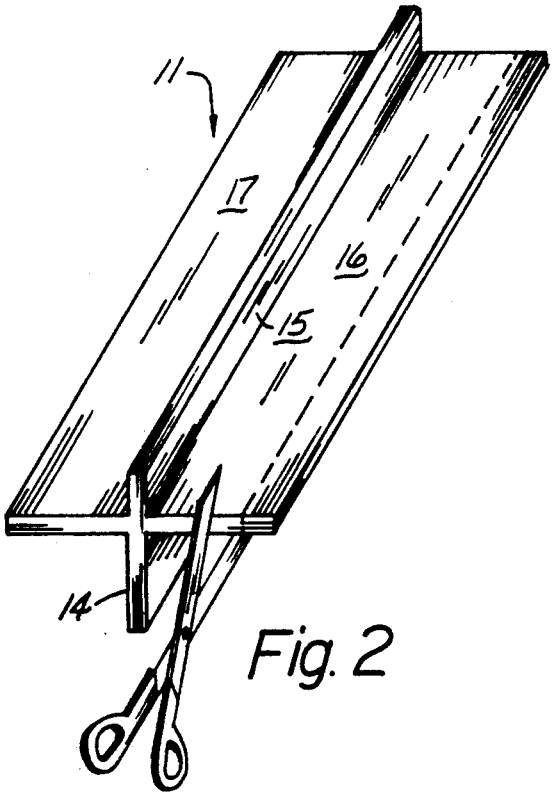
FIG. 2 is an isolated perspective view of the support unit.
Figure 4:
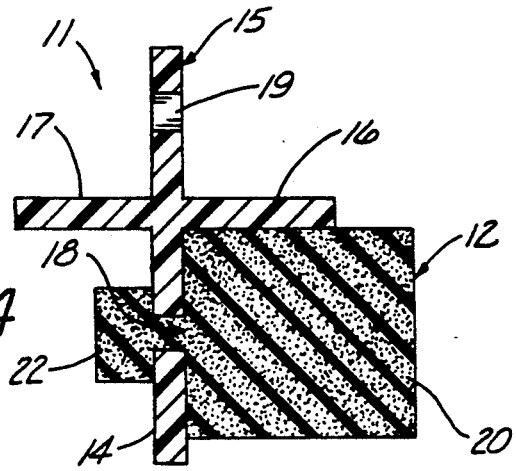
FIG. 4 is a cross-sectional of the apparatus taken through line 4—4 of FIG. 3.

As can best be seen by reference to FIGS. 2 and 4 the support unit (11) comprises a generally elongated relatively rigid yet severable support member (13) having a generally cruciform cross-sectional configuration.

In addition the cruciform configuration comprises; a lower stem panel (14); an upper stem panel (15); a right hand cross-arm panel (16); and, a left hand cross-arm panel (17); wherein, all of the panels (14) (15) (16) and (17) at least initially have a generally elongated rectangular configuration.

Furthermore as suggested in the dashed lines in FIGS. 2 and 3, selected portions (16') and (17') of the left and right hand cross-arm panels (16) and (17) are intended to be removed from the support member (13); to accommodate the latch (101) on the upper railing (102) of the lower window sash (100) and the stiles (201) and muntins (202) on the upper window sash (200) as will be explained in greater detail further on in the specification.

Figure 3:
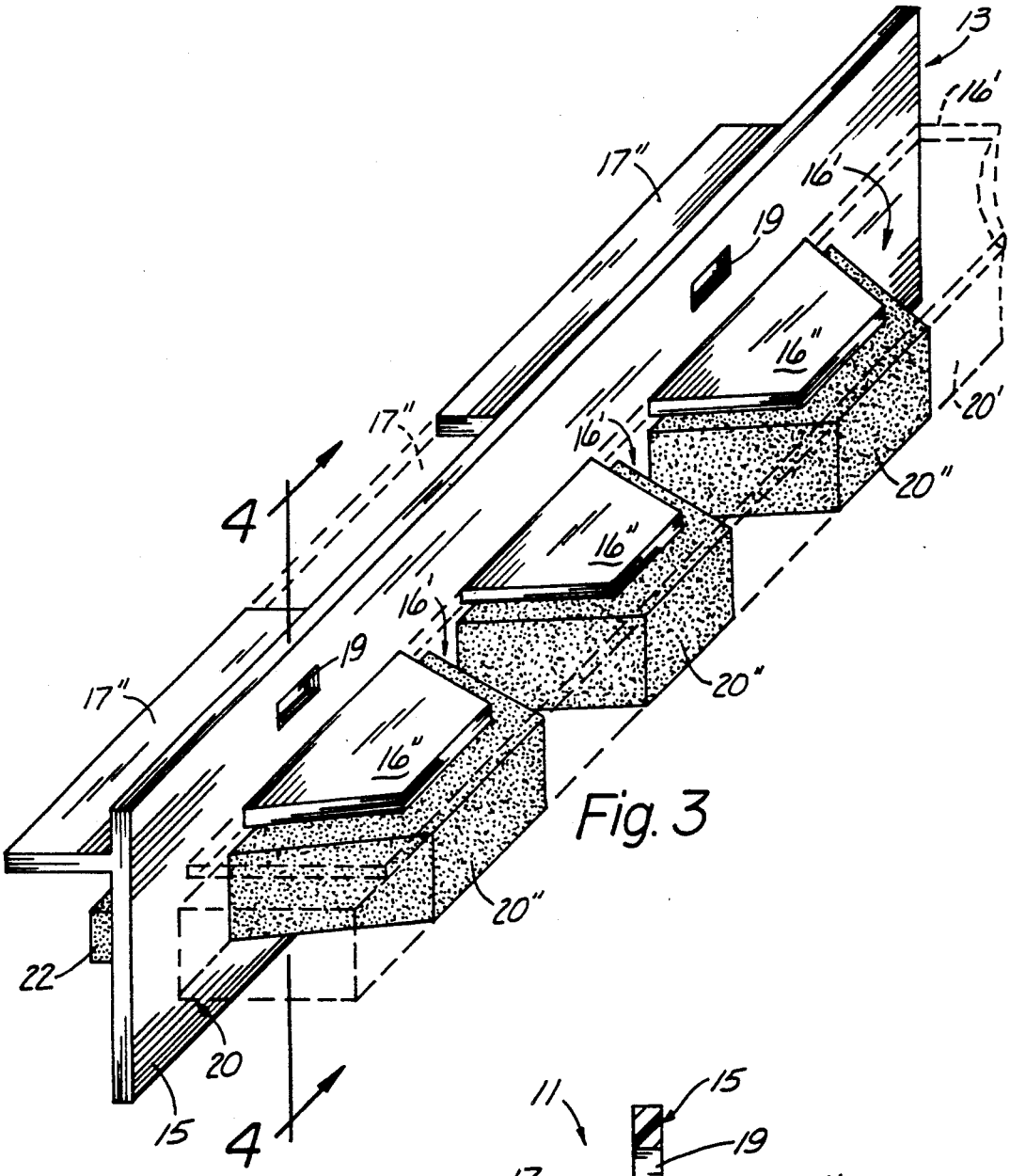
FIG. 3 is a perspective view of the apparatus having selective portions removed.
Figure 8:
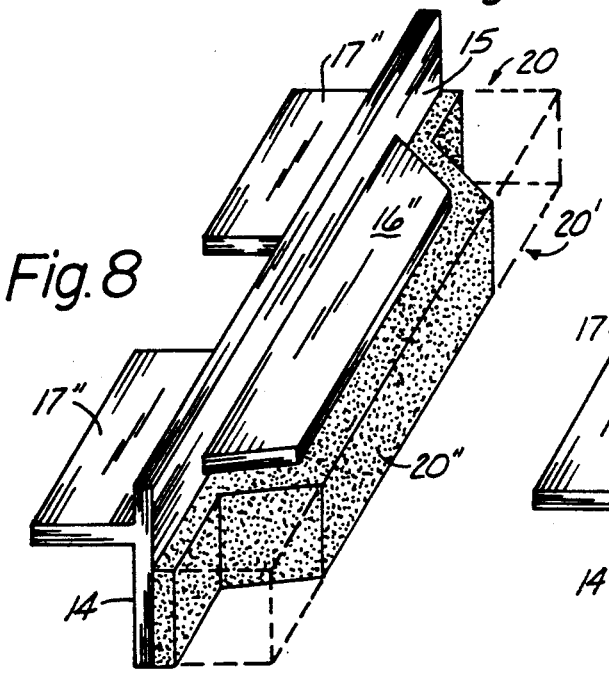
FIG. 8 is a perspective view of another form of the customized apparatus; and, FIG. 9 is a perspective view of another form of the customized apparatus.
Figure 9:
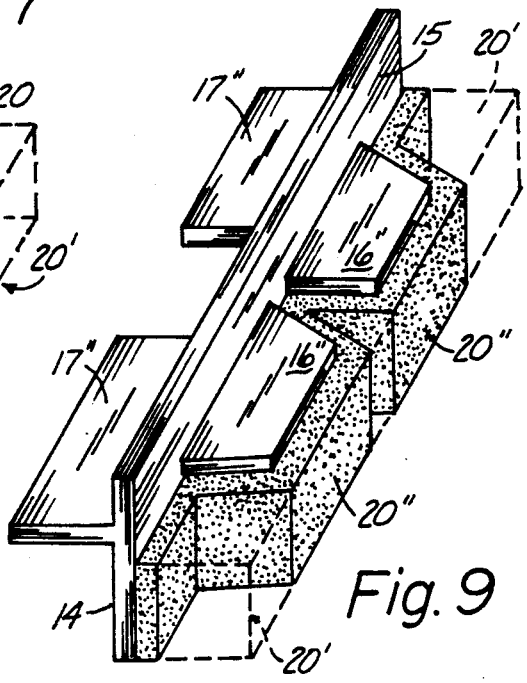

Turning now to FIGS. 3, 4, 8 and 9 it can be seen that in the preferred embodiment of this invention the resilient sealing unit (12) at least initially comprises an elongated generally rectangular block (20) of resilient severable sealing material wherein selected portions (20') of the sealing block (20) as indicated by the singly dashed lines of FIGS. 3, 8, and 9; are removed for reasons and purposes that will be explained presently.

As can be seen particularly by reference to FIG. 4, the main body of the resilient block (20) is operatively secured to adjoining surfaces of the lower stem panel (14) and the right hand cross-arm panel (16).

Furthermore, as can be seen by reference to FIGS. 3, 5, 8, and 9, the unsevered portions (20'') of the resilient sealing block project beyond the unsevered portion (16'') of the right hand cross-arm panel (16).

In practice the user would sever those portions (16') of the right hand cross-arm panel (16) such that the unsevered portions (16'') of the panel (16) would be spaced from the periphery of the stiles (201) and muntins (202) of the upper window sash (200). Then the resilient sealing block (20) would be operatively secured beneath the right hand cross-arm panel (16); wherein, the resilient sealing block (20) would subsequently be severed such that the unsevered portions (20″) of the sealing block would project beyond the unsevered portions (16″) to compressively engage the adjacent portions of the upper window sash (200) such as the window panel (203) muntins (202) and stiles (201).

Figure 5:
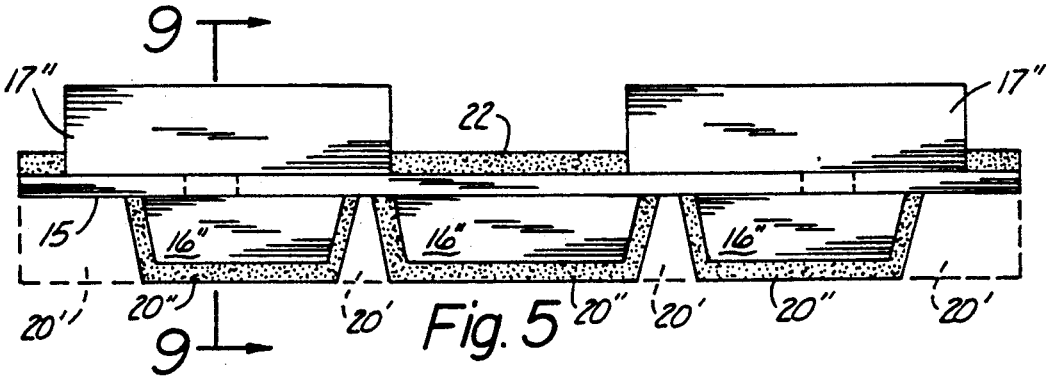
FIG. 5 is a top plan view of the customized apparatus depicted in FIG. 3.
Figure 6:
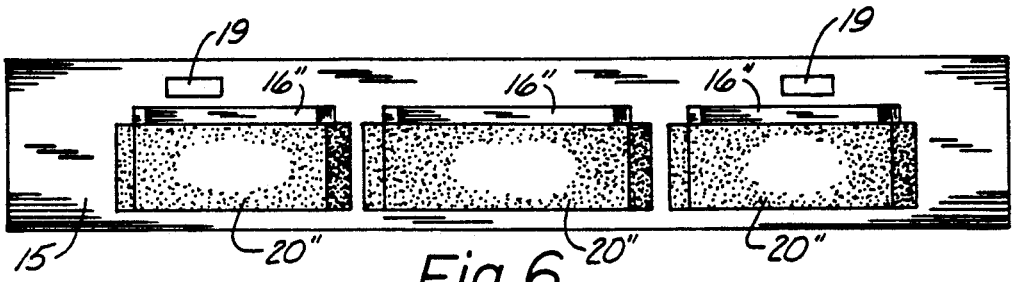
FIG. 6 is a front plan view of the customized apparatus.
Figure 7:
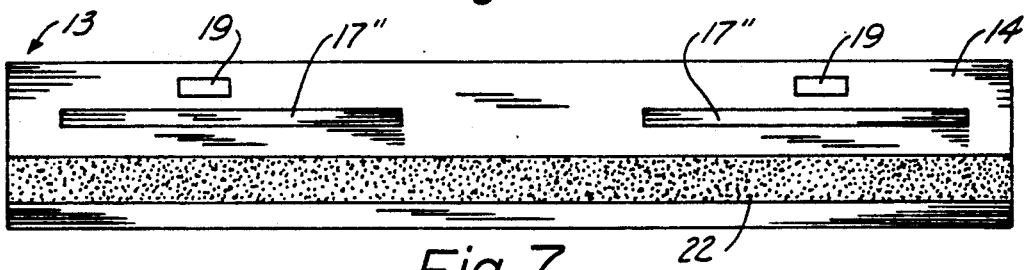
FIG. 7 is a rear plan view of the customized apparatus.

Turning now to FIGS. 4, 5, and 7, it can be seen that this invention further contemplates that the lower stem panel (14) will be provided with a plurality of elongated apertures (18) which are dimensioned to compressively receive a plurality of resilient tabs (22) which project outwardly from the rear face of the resilient sealing block (20) such that the resilient sealing block (20) may be releasably secured to the lower panel (14) of the support member (13).

In addition, the upper stem panel (15) is optionally provided with a plurality of discrete apertures (19) that can be used to facilitate the removal of the apparatus (10) after it has been installed.

Furthermore, as mentioned previously, the lower stem panel (14) provides a vertical support surface for the sealing unit (12); the upper stem panel (15) provides a means of grasping the apparatus (10) for insertion and removal relative to the window sashes (100) and (200); the right hand cross-arm panel provides a horizontal support surface for the sealing unit (12) that will prevent the resilient sealing block (20) from curling up as the apparatus is inserted; and, the left hand cross-arm panel (17) provides a horizontal support and spacing surface which rests on the top rail.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A weatherproof sealing apparatus for the openings created between upper and lower window sashes having stiles and window panes when the window sashes are disposed in an open position; wherein, the sealing apparatus comprises:

a support unit including a generally elongated rigid yet severable support member; wherein, said support member comprises at least two initially elongated rectangular panels connected together and disposed generally perpendicular to one another;

a resilient sealing unit operatively attached to the support member and including an initially generally elongated resilient rectangular sealing block operatively associated with said support member wherein both the support member and the block member have selected portions removed to accommodate portions of said upper window sash; wherein said sealing block is operatively attached at the juncture of said perpendicularly disposed panels; and, means for operatively positioning and supporting said support unit and said resilient sealing unit between the upper and lower window sashes.

2. A weatherproof sealing apparatus for the openings created between upper and lower window sashes having stiles and window panes when the window sashes are disposed in an open position; wherein, the sealing apparatus comprises:

a support unit including a generally elongated rigid yet severable support member comprising at least three initially elongated rectangular panels; wherein one of said at least three panels is disposed generally perpendicular to the other two of said at least three panels:

a resilient sealing unit operatively attached to the support member and including an initially generally elongated resilient rectangular sealing block operatively associated with said support member wherein both the support member and the block member have selected portions removed to accommodate portions of said upper window sash; wherein the resilient block is attached to at least one of said at least three panels; and, means for operatively positioning and supporting said support unit and said resilient sealing unit between the upper and lower window sashes.

3. A weatherproof sealing apparatus for the openings created between upper and lower window sashes having stiles and window panes when the window sashes are disposed in an open position; wherein, the sealing apparatus comprises:

a support unit including a generally elongated rigid yet severable support member comprising, four panels arranged in a generally cruciform configuration that includes a lower stem panel and upper stem panel; a right hand cross-arm panel and a left hand cross arm panel;

a resilient sealing unit operatively attached to the support member and including an initially generally elongated resilient rectangular sealing block operatively associated with said support member wherein both the support member and the block member have selected portions removed to accommodate portions of said upper window sash; and, means for operatively positioning and supporting said support unit and said resilient sealing unit between the upper and lower window sashes.

4. The sealing apparatus as in claim 3; wherein, said resilient sealing block is operatively secured to at least the right hand cross-arm panel.

5. The sealing apparatus as in claim 3; wherein, said resilient sealing block is operatively secured to at least the lower stem panel.

6. The sealing apparatus as in claim 3; wherein, said resilient sealing block is operatively secured to both the lower stem panel and the right hand cross-arm panel.

* * * * *